United States Patent [19]

Rosendahl et al.

[11] Patent Number: 5,004,051

[45] Date of Patent: Apr. 2, 1991

[54] METHOD AND MEANS FOR CLEANSING AND STORING DRILL CUTTINGS FROM DRILLING OPERATIONS IN THE SEA BOTTOM

[75] Inventors: Finn Rosendahl, Jar; Svein Fjeld, Oslo, both of Norway; Mamdouh M. Salama; Michael P. Gillen, both of Ponca City, Okla.

[73] Assignees: Norwegian Contracts A/S, Stabekk, Norway; Conoco Inc., Ponca City, Okla.

[21] Appl. No.: 406,355

[22] Filed: Sep. 12, 1989

[51] Int. Cl.[5] ..... E21B 43/34

[52] U.S. Cl. ..... 166/357; 175/5; 175/206; 175/207; 405/210

[58] Field of Search ..... 166/351, 357, 358; 175/6, 58, 86, 206, 213, 5, 207; 405/210

[56] References Cited

U.S. PATENT DOCUMENTS

| | | | |
|---|---|---|---|
| 3,429,128 | 2/1969 | Stafford et al. | 405/210 |
| 3,719,048 | 3/1973 | Arne et al. | 405/210 |
| 3,777,497 | 12/1973 | Edwards | 405/210 |
| 3,803,855 | 4/1974 | Malkiel | 405/210 |
| 4,141,377 | 2/1979 | Fernandez et al. | 137/236 |
| 4,416,565 | 11/1983 | Ostlund | 405/60 |
| 4,645,379 | 2/1987 | Grimsley et al. | 405/210 |

*Primary Examiner*—Hoang C. Dang

*Attorney, Agent, or Firm*—Wenderoth, Lind & Ponack

[57] ABSTRACT

A subsea storage structure for treatment and storing drill cuttings from drilling operations in the sea bottom includes a generally closed container or tank suitable to be positioned on the sea bottom near the drilling site, which tank is provided with an upper inlet for supply of drill cuttings, and an output to ambient water for water which is displaced during the supply of drill cuttings. The tank contains arrangements for cleansing of the drill cuttings and storage of accumulated oil, fluids and other constituents separated from the drill cuttings, and structure for extraction of the accumulated oil, fluids and other constitutents lighter than water.

22 Claims, 2 Drawing Sheets

22
28
18
26
4
42
2
20
42
39
32
24
14
36
40
38
30
9
8
6
34
16
12
10

22
39
2
14
16
9
52
50

METHOD AND MEANS FOR CLEANSING AND STORING DRILL CUTTINGS FROM DRILLING OPERATIONS IN THE SEA BOTTOM

BACKGROUND OF THE INVENTION

The present invention relates in general to subsea storage and cleansing of drill cuttings from holes drilled in the sea bed, especially in connection with hydrocarbon exploration. More particularly the invention relates to a storage structure designed to be positioned on the sea bottom for storage and cleansing of drill cuttings continuously delivered from nearby drilling operations.

Furthermore, the invention relates to a method for cleansing and separation of drill cuttings from oils, fluids and other contaminating constituents.

In connection with drilling operations in the sea bed drilling fluids and drilling slurries are pumped down during the drilling for different purposes, such as cooling, lubrication of the drill bits, prevention of corrosion, and also in order to create a pressure barrier in order to sustain those substantial pressures which may occur in the drill well when reaching ground formations with high pressures. Two main types of drilling fluids and drilling slurries are used, namely water-based and oil-based. Oil-based drilling fluids are primarily used to provide a lubrication of the drill string in the well and also to prevent corrosion of the drilling equipment. Oil-based drilling fluids are further used for drilling at high temperatures, in order to improve well stability and reduce scaling, and in order to control possible risks of water penetration. While drilling fluids and slurries are primarily used in order to create a pressure barrier in connection with high pressures in the well, they also serve as a supporting vehicle for the well cuttings which are generated during the drilling. Drill cuttings, contaminating oils, drilling fluids and the like are continuously transported up to the surface, i.e. to the drilling platform or drilling vessel where the drill cuttings and the drilling fluids to a certain degree are filtered for recovery of the drilling slurries. The drill cuttings are thereafter usually dumped in the sea and come to rest at the sea bottom.

The drilling cuttings normally contain both oil and various chemicals which usually are located as a film encompassing the drill cutting particles. If the cuttings are disposed of by dumping into the sea, oil and chemicals detach from the cutting particles and then normally will float up and form oily films on the sea surface, thereby contaminating the sea water.

One is here speaking of considerable quantities and volumes. Asan example, it can be mentioned that in the North Sea during the first six months of 1989 it was planned to drill altogether 125 oil and gas wells, and the drill cuttings from a single well may constitute approximately 500 metric tons. Knowing that oil contaminated drill cuttings may contain up to 50 volume % oil-based fluid one will understand that the risk of substantial environmental contaminations is rather great.

In this technical field great efforts have therefore been made to provide steadily improved methods for cleaning of the drill cuttings. For separation and cleansing of the drill cuttings are utilized both burning and/or chemical methods. It is obvious that such methods will be expensive, and the results have hitherto not been satisfactory.

An alternative to separation and cleansing is to accumulate the drill cuttings for transporting the same ashore with barges or the like, possibly for further cleansing and storage ashore. Such procedures obviously are rather expensive and new problems will arise in connection with storage ashore.

SUMMARY OF THE INVENTION

The main object of the present invention is to provide equipment and methods for dependable and economically attractive storage for the drill cuttings, either premanently or temporarily on the sea bottom close to the drilling site, such that one avoids contamination of the sea due to the drill cuttings in consequence of the contents of chemicals and/or oil.

The invention is generally characterized in that on the sea bottom is positioned a storage container or bin having a chamber separated from the environment in order to accomodate drill cuttings, and further to provide means for separation and if desired, transport of components and fluids which gradually are released from the drill cuttings in stored position.

The invention thus has several aspects and it will appear from the following that the invention can be realized in several fashions, depending upon whether the drill cuttings are to be permanently stored or temporarily stored on the sea bottom, and the storage means can be designed for separation and accumulation of fluids and materials stemming from the drill cuttings in one, two or several steps.

A special object of the invention is to provide a storage plant which to a large degree can be integrated as a natural part of the sea bottom topography on the storage site.

A subsea storage facility for storing drill cuttings from drilling operations in accordance with the invention comprises a closed container or tank designed to be positioned on the sea bottom at the drilling site, which tank is furnished with an upper inlet for supplying drill cuttings, and an outlet for water which is displaced during the supply of drill cuttings, and which tank further includes means for providing removal and separate accumulation of oils and other fluids from the drill cuttings.

The storage structure or tank may either be downwardly open or can be provided with a bottom wall. In the former embodiment the storage container can be hoisted up thereby leaving the drill cuttings in the tank on the sea bottom, while in the latter embodiment the storage tank can be hoisted up together with the drill cuttings.

In a preferred embodiment the tank is divided into two chambers, namely an inner chamber for receiving the drill cuttings, a water body being positioned between the layer of drill cuttings and the supply opening therefore at the upper end of the tank, and a second chamber which preferably is realized as an outer, ring-shaped chambers. The inner and outer chamber communicate through one or more pipelines suitably positioned to provide a separation procedure, and the outer chamber communicates with the ambient sea.

When drill cuttings are being supplied into the inner chamber a cleansing of the drill cuttings will take place simultaneously as the water inside the tank will be displaced from the inner chamber to the outer chamber and therefrom to the ambient water simultaneously as oils and fluids will accumulate in the upper parts of the respective chambers. When utilizing a storage means in accordance with the invention one will obtain both a preliminary cleansing and separation of oil and chemicals from the drill cuttings, and a long-term cleansing and separation. The oil and chemnicals from the drill cuttings will be securely accumulated in the container or tank and can be removed at certain time intervals or after the drilling operations have been completed.

In a preferred embodiment of the invention the storage tank is realized as an upwardly converging container, for instance formed as a frusto-conical body or as a pyramid with three, four or more sides. The lower part of the container body may in some cases be given a cylindrical form with downwardly directed skirts suitable for penetration of the sea bottom in order to stabilize the storage structure.

BRIEF DESCRIPTION OF THE DRAWINGS

Embodiments of storage containers for drill cuttings in accordance with the invention are illustrated in the accompanying drawings, where like numbers designate like parts in each figure and where.

In all figures like numbers refer to like parts.

DETAILED DESCRIPTION OF THE INVENTION

Figure 1:
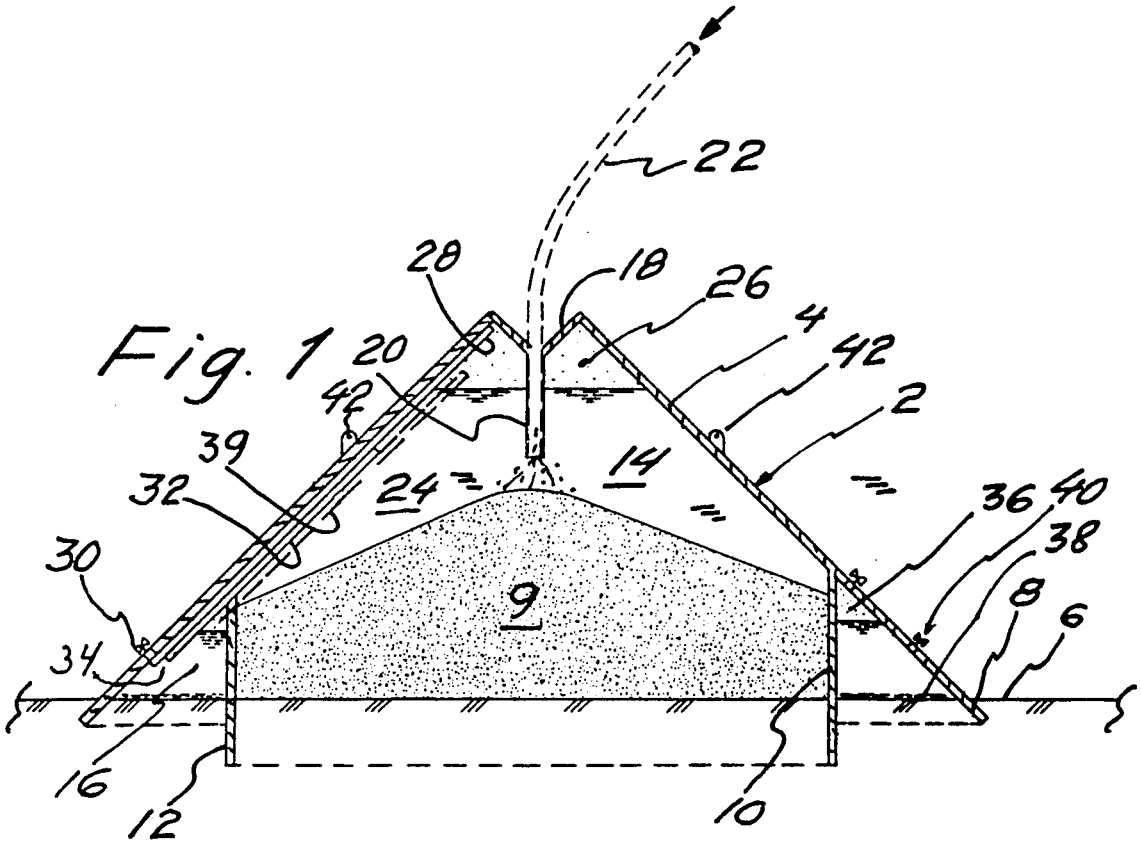
FIG. 1 is a vertical section through a storage tank for permanent deposition of drill cuttings on the sea bottom.

In FIG. 1 the reference number 2 designates a storage tank which has an outer conically shaped shell wall 4 and which wall will be anchored to the sea bed 6 after the shell wall with a ring-shaped skirt 8 has penetrated somewhat into the sea bottom 6. Inside the conically shaped wall 4 is installed a cylindrically shaped wall 10 sealingly attached to the inside of the conical wall 4 and having lower part 12 extending somewhat below the lowermost edge of the conical wall in order to penetrate down into the sea bottom 6 as shown. The ring-shaped wall 10 divides the interior of the tank into two chambers, namely an inner chamber 14 and an outer ring-shaped chamber 16. The upermost portion of conically shaped shell wall 4 is provided with a downwardly pointing bowl-shaped wall 18 which a the bottom is provided with a downwardly pointing tube-shaped inlet 20 adapted for being connected to a tube or supply pipe 22.

The remainder of the constructional details in the embodiment shown in FIG. 1 shall be described in connection with the use or function of the structure. The drill cuttings are supplied continuously through the hose or pipe 22 down into the inside bin or chamber 14, where the drill cuttings 9 will accumulate on the bottom as shown, covered by a water body 24. Oil and other fluids contained in or clinging to the drill cuttings will either immediately or later leave the surface of the drill cuttings and float upwardly and accumulate below the top roof of the inner chamber 14 as a fluid body 26 as shown. From this upper part of the inner chamber 14 referred to as an "oil trap", leads a pipe 28 attached to the inside wall of the shell 4 down to an outlet 30 including a valve to which can be attached a not shown hose leading up to a vessel for removal of accumulated oil and fluid. Removal of oils and fluids from the oil trap 26 can be done from time to time or after the drilling is finalized.

Gradually, as drill cuttings fill up the chamber 14, a corresponding volume of water will be displaced therefrom through an open pipe 32 communicating from an intermediate level in the chamber 14 down to an intermediate level 34 in the outer ring-shaped chamber 16. The pipe 32 is suitably attached along the inside conical wall as shown. The outer ring-shaped chamber 16 will constitute a second stage of the cleansing or separation process, the inner chamber 14 constituting the first step. Inside the ring-shaped chamber 16 oil and other residuals lighter than water will accumulate in the upper part 36 of the same as shown. From the space 36 a containments pipe 39 (dashed lines) can lead to the space 26 such that oil and the like in space 36 will flow up to space 26. Other residuals heavier than water will accumulate on the bottom as a layer 38 as shown. The circular outside chamber 16 is open to the ambient sea through a port 40 preferably provided with a valve as shown. The port 40 is preferably located diagonally opposite the pipe 32, whereby there is provided a dual, relatively long flow path for the displaced water, thereby obtaining good separation between the displaced water and oils, respectively. The dual cross section of the outer chamber 16 is many times larger than the inlet pipe 22 thus providing a slow laminar flow of displaced water from the pipe 32 to the outlet port 40. Particles heavier than water that may have followed discharge water into the outer chamber will settle to the floor of the outer chamber, as at 38.

One will understand, that by the shown and described storage means for drill cuttings, one will obtain a two-step cleansing of the displaced water. Oils and the like from the drill cuttings will be separated by gravity from the drill cuttings in chamber 14 and accumulated separately for removal.

After the drilling operations in this particular site have been finalized and after the most substantial part of the oils and fluids which followed the drill cuttings from the drilling operations have been separated therefrom, separated constituents may be pumped up to a surface vessel or can be left in the tank for later removal. The storage tank including the drill cuttings can be left behind on the sea bottom, since the tank is intentionally given a shape which more or less will conform with the sea bottom and therefore will constitute little or no risk for fishing gear and the like.

If it is desirable to remove the storage means after the drilling operations have been finalized, such removal can be carried out by releasing the tank from the sea bottom in known fashion, whereafter it can be lifted up with hoisting equipment including wires or chains attached to suitable hoisting ears, 42 mounted on the outside of the conical shell. The drill cuttings will then be left on the sea bottom and can, if necessary, be covered with a layer of sand, gravel or the like. Alternatively, or additionally, one may, prior to positioning the storage tank, dig out a recess in the sea bottom on the storaage site such that drill cuttings subsequent to removal of the storage tank will be left in such recess more or less flush with the adjacent sea bottom.

Figure 2:
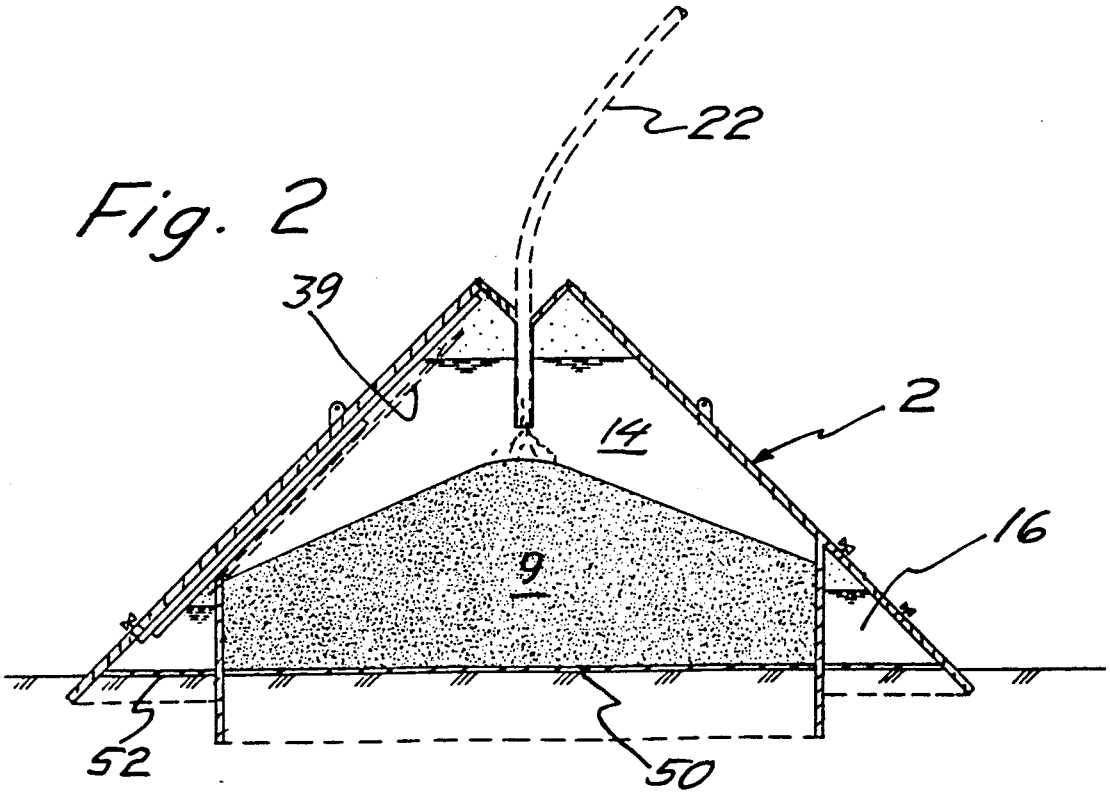
FIG. 2 is a similar sectional view showing a storage tank which can be closed completely, either for permanent deposition of drill cuttings on the sea bottom or designed for removal, contents of drill cuttings, as a closed unit.

FIG. 2 is a sectional lateral view similar to FIG. 1 illustrating an alternative embodiment for a storage structure in accordance with the invention and which is provided with a closed bottom 50 constituting a floor of the inner chamber 14 and if desired a bottom wall or floor 52 is also mounted in the ring-shaped outer chamber 16. This embodiment of the inventuon can be left on the sea bottom as a permanent, closed depot, or it can be removed together with its contents of drill cuttings, drill slurry, or oil residuals, etc.

Figure 3:
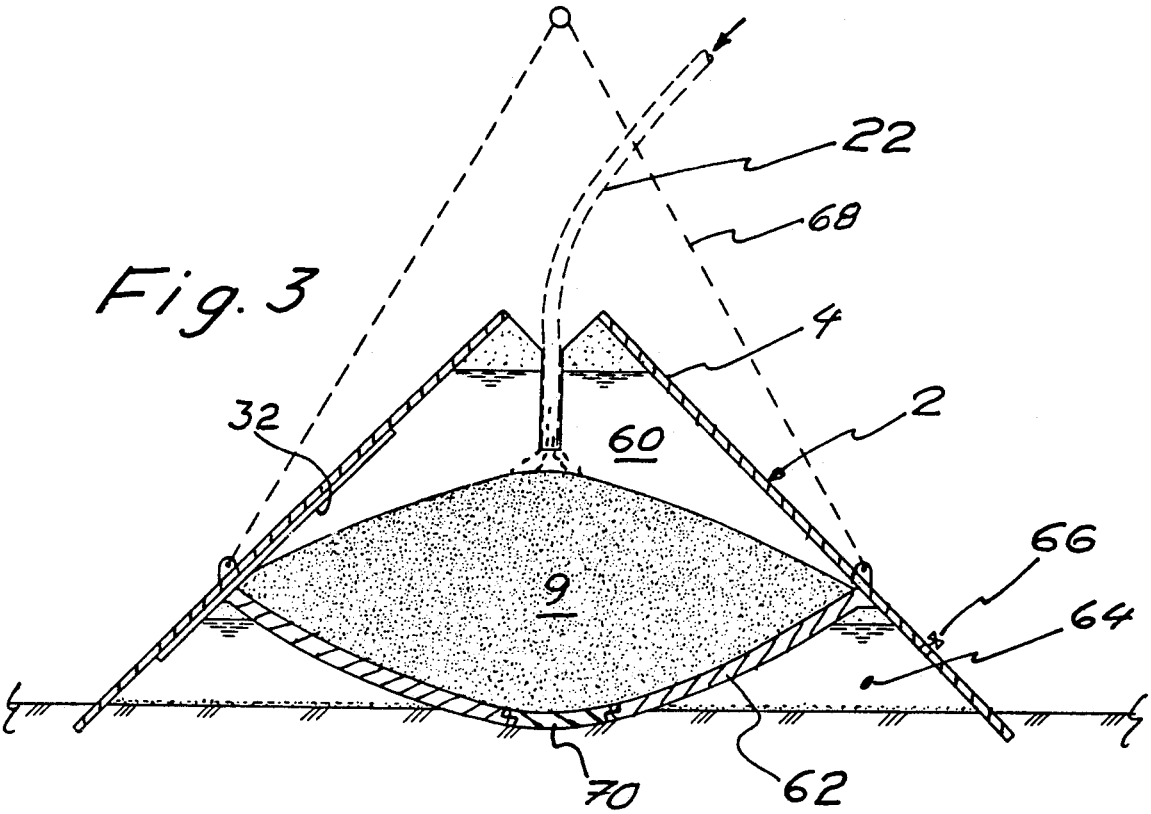
FIGS. 3 and 4 are similar views of two further embodiments of storage containers which may be removed from the sea bottom with the contents of drill cuttings.
Figure 4:
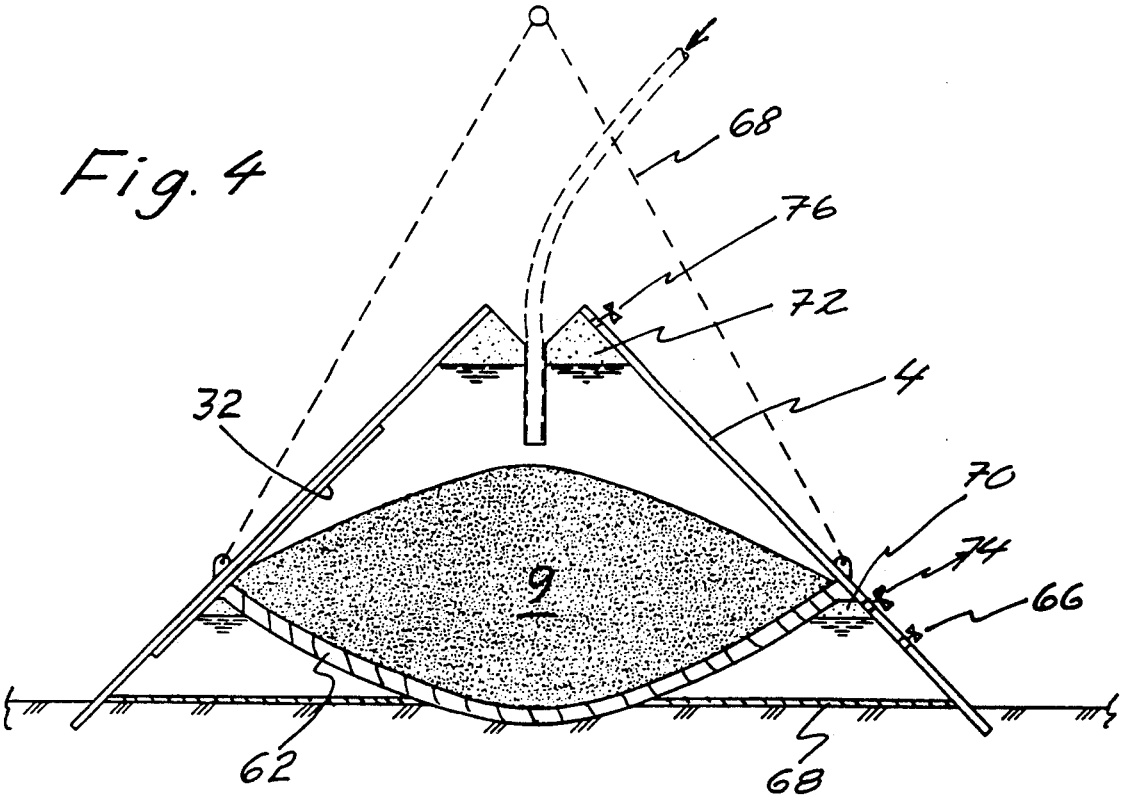

FIGS. 3 and 4 illustrate alternative preferred embodiments of storage structures in accordance with the invention used if it is required that the drill cuttings shall not be deposited on the sea bottom. The inside or center chamber 60 in this embodiment is provided with a strong bottom floor 62, preferably shaped as shown as a bowl-shaped container. It will be understood that with a such bowl-shaped container 62 the same will both provide a wall creating outer chamber 64 and a container for the drill cuttings 9. The cleansing process will otherwise take place in the same manner as described in connection with FIGS. 1 and 2, and similar numbers designate similar parts. The outer chamber 64 can be provided with ports 66 for discharge of water and for communication with ambient water. The entire storage structure including the contents of drill cuttings can be lifted up with wires or chains 68 to a vessel and therefrom ashore for further cleansing and deposition. In order to facilitate later removal of the heap of drill cuttings 9 in the storage bin 62, the bottom of the same can be provided with a drain plug or the like. Oils and fluids 70, 72 can be stored in the tank or removed through valves 74 and 76.

In the embodiment shown in FIG. 3 the contents of the inner chamber 14 will be hoisted up together with the storage structure. In FIG. 4 is shown an embodiment similar to the one shown in FIG. 3 with the exception that also the outer chamber 16 is provided with a bottom or bottom floor 68 such that the contents of this chamber also will be raised when the storage structure is hoisted in order to be brought ashore.

The lower part of the tank well 4 can be made cylindrical with vertical skirts for better penetration of the sea bottom.

A storage structure in accordance with the invention can be made of any suitable structural material, but a reinforced plastics can be used.

With regard to the form or configuration of a storage structure in accordance with the invention, a conical shape as shown is preferred, with respect to simplicity from a structural point of view, from a functional point of view and as mentioned with regard to the environment advantages obtained through a such shape. However, it will be understood that, for instance, a cylindrical shape could be used or a storage structure with a partly conical and partly cylindrical outer shell. The storage structure with a double conical upper part as shown is very practical since one obtains a hopper-like receiving inlet for the hose 22 for supply of drill cuttings.

What is claimed is:

1. A subsea storage structure for storing drill cuttings from a drilling operation in a sea bottom and for separating oil and other contaminating fluids from such drill cuttings, said structure comprising:

a generally upwardly converging tank defined by an outer shell having an interior;

an inner wall sealingly connected to said shell inwardly thereof and dividing said interior into a central chamber and an annular chamber surrounding said central chamber;

wherey said tank may be positioned on the sea bottom with said chambers filled with sea water;

upper inlet means in said tank for introducing drill cuttings into said central chamber such that the drill cuttings settle to the bottom thereof while displacing sea water therein upwardly above such settled drill cuttings and such that oil and other contaminating fluids will separate from the settled drill cuttings and will rise upwardly through and accumulate above the sea water positioned above the settled drill cuttings, thereby performing a first separation step;

a pipe sealingly extending through said inner wall and having an inlet end at an intermediate level of said central chamber and an outlet end at an intermediate level of said annular chamber and forming means for passing sea water displaced by the drill cuttings entering said central chamber from said central chamber to be said annular chamber, whereby any oil and other contaminating fluids remaining in such sea water passed into said annular chamber by said pipe will rise up and accumulate in an upper portion of said annular chamber above the sea water therein, thereby performing a second separation step; and outlet means, extending from said annular chamber and communicating with ambient sea water surrounding said structure, for discharging from said annular chamber to the ambient sea water that sea water displaced by the sea water entering said annular chamber through said pipe after separation of any oil and other contaminating fluids from that sea water.

2. A structure as claimed in claim 1, wherein said outlet means is located substantially diametrically opposite said pipe relative to said annular chamber.

3. A structure as claimed in claim 1, wherein said inner wall comprises a cylinder having a lower end defining a skirt to be penetrated into the sea bottom.

4. A structure as claimed in claim 3, wherein said cylinder is open downwardly, such that in use the sea bottom defines the bottom of said central chamber.

5. A structure as claimed in claim 3, further comprising a floor structure extending across and closing the interior of said cylinder and defining the bottom of said central chamber.

6. A structure as claimed in claim 1, wherein said outer shell has a lower end defining a skirt to be penetrated into the sea bottom.

7. A structure as claimed in claim 6, wherein said outer shell is downwardly open, such that the sea bottom defines the bottom of said annular chamber.

8. A structure as claimed in claim 6, further comprising a floor extending between said inner wall and said outer wall and closing and defining the bottom of said annular chamber.

9. A structure as claimed in claim 1, wherein said outer shell is conical.

10. A structure as claimed in claim 1, wherein said outer shell is shaped as a pyramid with at least three sides.

11. A structure as claimed in claim 1, further comprising an additional pipe sealingly extending through said inner wall and having an upper inlet end located in and open within an uppermost portion of said central chamber and a lower outlet end located in said annular chamber and connected to a valved discharge through said outer shell, such that the oil and other contaminating fluids accumulated in said uppermost portion of said central chamber will be, during supply of the drill cuttings through said upper inlet to said central chamber, expelled through said additional pipe and said valved discharge.

12. A structure as claimed in claim 1, further comprising a contaminants pipe sealingly extending through said inner wall and having an inlet end positioned in and open to said upper portion of said annular chamber and an outlet end positioned in and open to an uppermost portion of said central chamber, such that oil and other contaminating fluids accumulated in said upper portion of said annular chamber will pas through said contaminants pipe and join the oil and other contaminating fluids accumulated in said uppermost portion of said central chamber.

13. A structure as claimed in claim 1, further comprising means for removing oil and other contaminating fluids accumulated in an uppermost portion of said central chamber.

14. A structure as claimed in claim 1, further comprising means for removing oil and other contaminating fluids accumulated in said upper portion of said annular chamber.

15. A structure as claimed in claim 1, wherein said inner wall comprises a bowl-shaped member defining a bottom of said central chamber.

16. A structure as claimed in claim 1, further comprising attachment means connected to the exterior of said tank for connection to a hoist to enable said structure to be lifted from the sea bottom.

17. A method for storing drill cuttings from a drilling operation on a sea bottom and for separating from said drill cuttings oil and other contaminating fluids, said method comprising:

positioning on the sea bottom adjacent the drilling operation a structure including a generally upwardly converging tank defined by an outer shell having an interior, an inner wall sealingly connected to said shell inwardly thereof and dividing said interior into a central chamber and an annular chamber surrounding said central chamber, an upper inlet into said central chamber, a pipe sealingly extending through said inner wall and having an inlet end in said central chamber and an outlet end in said annular chamber, with said chamber being filled with sea water;

introducing drill cuttings from said drilling operation through said upper inlet into said central chamber, thereby causing said drill cuttings to settle to the bottom thereof while displacing sea water therein upwardly above such settled drill cuttings, and further causing oil and other contaminating fluids with said drill cuttings to separate from said settled drill cuttings and to rise upwardly through and accumulate above the sea water positioned above said settled drill cuttings, thereby performing a first separation step;

further causing the sea water displaced by said drill cuttings entering said central chamber to pass through said pipe from said central chamber to said annular chamber, thereby causing any oil and other contaminating fluid remaining in such sea water passed through said pipe into said annular chamber to rise up and accumulate in an upper portion of said annular chamber above said sea water therein, thereby forming a second separation step;

additionally causing that sea water from said annular chamber that is displaced by said sea water entering said annular chamber through said pipe to be discharged from said annular chamber through said outlet to ambient sea water surrounding said structure after separation of any oil and other contaminating fluids from that sea water; and causing any contaminants in said sea water that are heavier than sea water to settle to the bottom of said annular chamber.

18. A method as claimed in claim 17, further comprising removing said accumulated oil and other contaminating fluids from the uppermost portion of said central tank.

19. A method as claimed in claim 17, furth comprising removing said accumulated oil and other comtaminating fluids from said upper portion of said annular chamber.

20. A method as claimed in claim 17, comprising providing said outlet from said annular chamber at a position substantially diametrically opposite said pipe relative to said annular chamber.

21. A method as claimed in claim 17, further comprising providing said central chamber with an open lower end, and raising said structure from said sea bottom, whereby said settled drill cuttings remain on said sea bottom.

22. A method as claimed in claim 17, furth comprising providing said central chamber with a closed bottom, and raising said structure with said settled drill cuttings therein from said sea bottom.

* * * * *